US008979207B2

(12) United States Patent
Bachar

(10) Patent No.: US 8,979,207 B2
(45) Date of Patent: Mar. 17, 2015

(54) SEAT CUSHION AND SEATING APPARATUS USING THE SAME, AND KIT

(71) Applicant: Offer Bachar, Toronto (CA)

(72) Inventor: Offer Bachar, Toronto (CA)

(73) Assignee: Airopedic International Inc., Toronto (CA)

( * ) Notice: Subject to any disclaimer, the term of this patent is extended or adjusted under 35 U.S.C. 154(b) by 0 days.

(21) Appl. No.: 13/910,466

(22) Filed: Jun. 5, 2013

(65) Prior Publication Data

US 2014/0054948 A1 Feb. 27, 2014

Related U.S. Application Data

(60) Provisional application No. 61/693,749, filed on Aug. 27, 2012.

(51) Int. Cl.
*A47C 7/14* (2006.01)
*A47C 7/02* (2006.01)

(52) U.S. Cl.
CPC . *A47C 7/02* (2013.01); *A47C 7/021* (2013.01); *A47C 7/024* (2013.01); *A47C 7/14* (2013.01)
USPC ..... 297/452.41

(58) Field of Classification Search
USPC ..... 297/452.41
See application file for complete search history.

(56) References Cited

U.S. PATENT DOCUMENTS 4,643,481 A * 2/1987 Saloff et al. ..... 297/452.41 X
4,753,480 A * 6/1988 Morell ..... 297/452.41 X
5,369,828 A * 12/1994 Graebe ..... 297/452.41 X
5,461,741 A * 10/1995 Graebe ..... 297/452.41 X
5,634,685 A * 6/1997 Herring ..... 297/452.41 X
5,678,891 A * 10/1997 O'Neill et al. ..... 297/452.41 X
5,713,631 A * 2/1998 O'Neill et al. ..... 297/452.41 X
5,893,184 A * 4/1999 Murphy ..... 297/452.41
6,036,271 A * 3/2000 Wilkinson et al. ..... 297/452.41
6,070,942 A * 6/2000 Barton et al. ..... 297/452.41
6,209,159 B1 * 4/2001 Murphy ..... 297/452.41 X
6,234,578 B1 * 5/2001 Barton et al. ..... 297/452.41
6,241,320 B1 * 6/2001 Chew et al. ..... 297/452.41 X
6,502,263 B1 * 1/2003 Rowley et al. ..... 297/452.41 X
6,551,450 B1 * 4/2003 Thomas et al. ..... 297/452.41 X
6,623,080 B2 * 9/2003 Clapper ..... 297/452.41
6,901,617 B2 * 6/2005 Sprouse et al. ..... 297/452.41 X
8,678,499 B2 * 3/2014 Kelly ..... 297/452.41 X
2004/0160112 A1 * 8/2004 Clapper ..... 297/452.41
2012/0292958 A1 * 11/2012 Sprouse, II ..... 297/452.41 X

* cited by examiner

*Primary Examiner* — Rodney B White
(74) *Attorney, Agent, or Firm* — Renner, Otto, Boisselle & Sklar, LLP

(57) ABSTRACT

A seat cushion for a chair or separately usable, includes a support base having a top and bottom, a fluid bladder supported by the support base above at least part of the top of the support base, the fluid bladder having a fluid chamber forming plural bladder sections, a biasing member in the fluid chamber tending to bias the fluid chamber to an at least partly expanded condition, a resilient retaining covering over the fluid bladder holding the fluid bladder on the support base, a valve mechanism in fluid coupled relation to the fluid bladder to provide and to exhaust fluid from the fluid chamber, a mechanical connection of the valve mechanism to the support base, mechanical coupling and restricted fluid flow coupling of the bladder sections. A seating apparatus, e.g., a chair, including the seat cushion. A bladder-type fluidic seat cushion in a kit.

35 Claims, 8 Drawing Sheets

SEAT CUSHION AND SEATING APPARATUS USING THE SAME, AND KIT

CROSS-REFERENCE TO RELATED APPLICATION

This application claims the benefit of U.S. Provisional Patent Application Ser. No. 61/693,749, filed Aug. 27, 2012, the entire disclosure of which is hereby incorporated by reference.

TECHNICAL FIELD

The present invention relates generally, as indicated, to seat cushions and seating apparatuses using the same.

BACKGROUND

Many different types of seating apparatus exist. For example, there are chairs (such as office chairs, table chairs typically used at an eating table or counter, wheel chairs, and so on), seats (such as vehicle seats, stadium seats, theater seats, and so on), stools, and so on. Various adjustments have been developed for such seating apparatuses, for example, lumbar support, tilt and height adjustments. These adjustments may improve seating comfort for a user.

SUMMARY

A problem exists with seating apparatuses in that there is that the seat portion (sometimes referred to as "seat") that primarily bears the weight of a user (the portion on which the user sits) becomes uncomfortable after a user has been sitting thereon for a relatively long period of time. To relieve discomfort after sitting for a period of time, a user may get up from a chair relatively frequently; in an office environment this may reduce efficiency; at a sporting event the user may miss a spectacular play; in a social event, the user may lose continuity of a particular interaction; and so on.

A need exists to alleviate at least the above problems.

According to an aspect of the present invention a seat cushion is dynamically adjustable by itself and/or by a user and tends to increase the amount of time that a user might sit comfortably on the seating apparatus that has such seat cushion.

An aspect of the invention relates to a seat cushion, including a support base having a top and bottom, a fluid bladder supported by the support base above at least part of the top of the support base, the fluid bladder having a fluid chamber, a biasing member in the fluid chamber tending to bias the fluid chamber to an at least partly expanded condition, a resilient retaining covering over the fluid bladder, a valve mechanism in fluid coupled relation to the fluid bladder to provide and to exhaust fluid from the fluid chamber, and a mechanical connection of the valve mechanism to the support base.

Another aspect relates to at least part of the bladder is molded to the valve mechanism as an integral structure.

Another aspect relates to at least part of the valve mechanism extends through the support base and is accessible beneath the support base for manual operation to provide and to exhaust fluid from the fluid chamber.

Another aspect relates to the biasing member includes a resilient open cell foam-like material.

Another aspect relates to the support base is relatively rigid compared to the fluid bladder that is relatively more flexible than the support base, and another aspect relates to the fluid bladder is generally in parallel overlying relation to the support base and overlies less than the entire area of the support base.

Another aspect relates to the valve mechanism is mechanically connected to the support base and to the fluid bladder to retain the fluid bladder to the support base.

Another aspect relates to the fluid bladder includes a resilient bias member tending to urge the fluid bladder to an open volume state of the fluid chamber.

Another aspect relates to the valve mechanism includes a tube and a two-way manually operable flow control valve.

Another aspect relates to the valve mechanism is selectively actuable to permit fluid to flow into and out from the fluid chamber and when the valve mechanism is unactuated it blocks fluid.

Another aspect relates to the fluid bladder includes at least two discrete bladder sections connected together, each bladder section having a fluid chamber, and fluid connection between the bladder sections providing restricted fluid flow between the respective fluid chambers.

Another aspect relates to the valve mechanism is connected to one of the discrete bladder sections.

Another aspect relates to the resilient retaining covering includes resilient foam material.

According to another aspect a fabric-outer covering is provided.

Another aspect relates to the fluid bladder has at least two discrete bladder sections that are resilient, capable of containing a fluid, and extending in side by side generally parallel relation to each other, a mechanical connection connecting adjacent bladder sections, the mechanical connection including a substantial extent in a direction that generally is from the front toward the back of the support base, and that does not transmit fluid between bladder sections and a lesser extent that provides restricted fluid flow between bladder sections, and a resilient retaining covering material over the fluid bladders.

According to another aspect, a seat cushion includes a support base having a front and back, a fluid bladder having at least two discrete bladder sections that are resilient, capable of containing a fluid, and extending in side by side generally parallel relation to each other, a mechanical connection connecting adjacent bladder sections, the mechanical connection including a substantial extent in a direction that generally is from the front toward the back of the support base, and that does not transmit fluid between bladder sections and a lesser extent that provides restricted fluid flow between bladder sections, and a resilient retaining covering material over the fluid bladders.

Another aspect relates to the lesser extent of the mechanical connection provides fluid flow paths between respective bladder sections and Another aspect relates to the flow path dimensions are sufficiently small to restrict unimpeded fluid flow between bladder sections providing in use the sensation of flow viscous material between bladder sections in response to difference in pressure applied to respective bladder sections.

Another aspect relates to the mechanical connection includes at least two lesser extent portions that respectively are spaced apart from each other.

Another aspect relates to at least two lesser extent portions of the mechanical connection are, respectively, in relative proximity to respective ends of the mechanical connection.

Another aspect relates to the bladder sections are of generally rectangular shape, and the mechanical connection extends between bladder sections substantially along the entire length of a pair of connected side edges of the bladder sections.

Another aspect relates to the fluid bladder includes a fluid chamber, and further including a resilient bias member tending to urge the fluid bladder to an open volume state of the fluid chamber.

According to another aspect there is provided a valve mechanism in fluid coupled relation to the fluid bladder to provide and to exhaust fluid from the fluid chamber.

According to another aspect there is provided a mechanical connection of the valve mechanism to the support base.

Another aspect relates to the resilient retaining covering includes resilient foam material, and Another aspect relates to the foam material has a cavity, the bladder positioned at least partly in the cavity, and walls of the cavity constrain movement of the bladder and in cooperation with the support base retain the bladder in position with the bladder sections in side by side relation.

According to another aspect the seat cushion includes a fabric cover.

According to another aspect, a seat cushion includes a support base having an edge, a fluid bladder supported by the support base, and a resilient material over at least part of the fluid bladder, the resilient material including a cavity portion, at least part of the fluid bladder in the cavity, and a wall portion of the resilient material covering an edge of the support base.

Another aspect relates to the fluid bladder includes plural bladder sections, each having a fluid chamber, the bladder sections connected in side by side parallel relation and the fluid chambers being fluidically coupled to each other via restrictive fluid flow paths, and the resilient member resiliently holds the bladder sections in generally fixed relation to each other while permitting some movement of respective bladder sections and expansion and contraction of respective fluid chambers of the bladder sections as fluid flows between respective fluid chambers in response to external pressure applied to the fluid bladder.

Another aspect relates to the resilient material is a resilient foam material.

Another aspect relates to the support base is substantially rigid.

Another aspect relates to fluid in the fluid bladder is air.

Another aspect relates to respective portions or sections of the fluid bladder are fluidically interconnected to permit flow of fluid between respective portions or sections in response to external pressure applied to the fluid bladder.

Another aspect relates to the seat cushion including a support structure supporting the seat cushion in orientation for a person to sit on the seat cushion.

According to another aspect, a seat kit includes a fluid bladder having at least two interconnected bladder sections, a mechanical connection between the bladder sections, including a restrictive fluid flow connection between the bladder sections, the bladder sections being generally planar and foldable in overlying relation over each other along the mechanical connection, a valve in a side edge of at least one of the bladder sections, and a container to hold the bladder with the bladder sections in folded relation, the bladder being removable from the container for unfolded use as a seat cushion.

Another aspect relates to the bladder includes exterior walls bounding a chamber, and a resilient compressible material inside the chamber.

According to another aspect, the seat cushion includes a resilient cover overlying at least one surface of both bladder sections.

According to another aspect, the seat cushion includes a fabric-like cover overlying the resilient cover.

To the accomplishment of the foregoing and the related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

Other systems, methods, features, and advantages of the invention will be or become apparent to one with skill in the art upon examination of the following drawings and detailed description. It is intended that all such additional systems, methods, features, and advantages be included within this description, be within the scope of the present invention, and be protected by the accompanying claims.

Although the invention is shown and described with respect to one or more embodiments, it is to be understood that equivalents and modifications will occur to others skilled in the art upon the reading and understanding of the specification. The present invention includes all such equivalents and modifications, and is limited only by the scope of the claims.

Also, although the various features are described and are illustrated in respective drawings/embodiments, it will be appreciated that features of a given drawing or embodiment may be used in one or more other drawings or embodiments of the invention.

It should be emphasized that the term "comprise/comprising" when used in this specification is taken to specify the presence of stated features, integers, steps or components but does not preclude the presence or addition of one or more other features, integers, steps, components or groups thereof."

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views and primed reference numerals designate parts that are similar to parts designated by the same unprimed reference numerals.

In the annexed drawings.

DESCRIPTION

Figure 1:
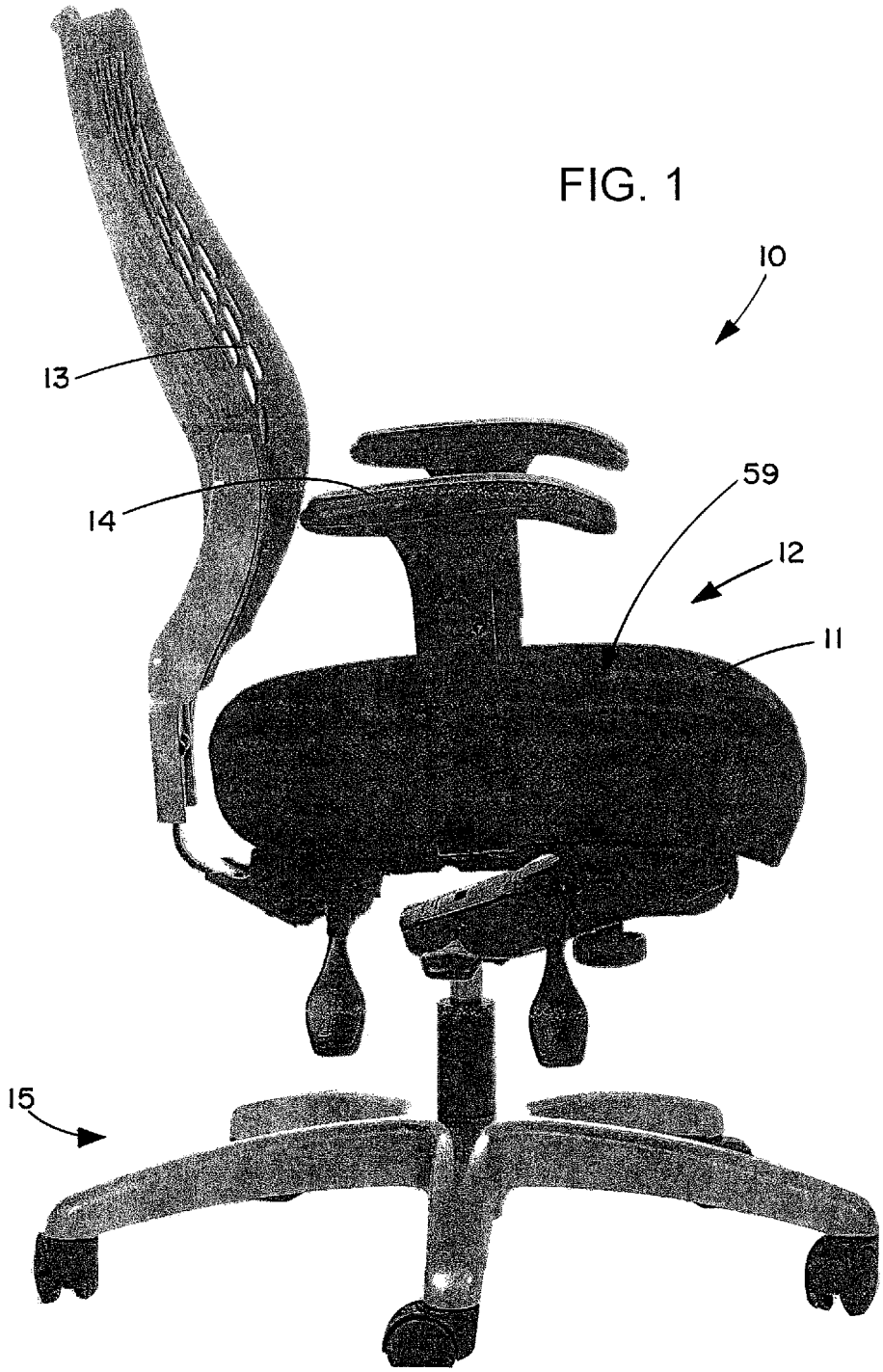
FIG. 1 is an illustration of a seating apparatus (e.g., a chair) including the seat cushion according to an embodiment.

Referring, now, to the drawings, like reference numerals refer to like parts in the several figures and primed reference numerals may refer to parts that are similar to parts that are designated by the same unprimed reference numerals.

In FIG. 1 a seating apparatus 10 that includes a seat cushion 11 in accordance with the invention is illustrated; in FIG. 1 the seating apparatus is a chair, but it will be appreciated that the seat cushion as shown or of another form factor may be used in other types of seating apparatuses. Some examples of seating apparatuses are mentioned above, but those examples are not exclusive, and it will be appreciated that the seat cushion of the invention may be used with other types of seating apparatus.

As is seen in FIG. 1, the seat cushion 11 is the seat 12 for the chair 10. Additionally, the chair 10 includes a back rest or support 13 that supports the seat cushion in orientation for a person to sit on the seat cushion, arm rests or supports 14 and a base 15. These parts 13-15 are exemplary; and other types may be included in the chair. Also, of course, as was mentioned above, the chair 10 only is exemplary of a seating apparatus that may include the invention; and the invention may be embodied in other types of seating apparatuses.

Figure 2:
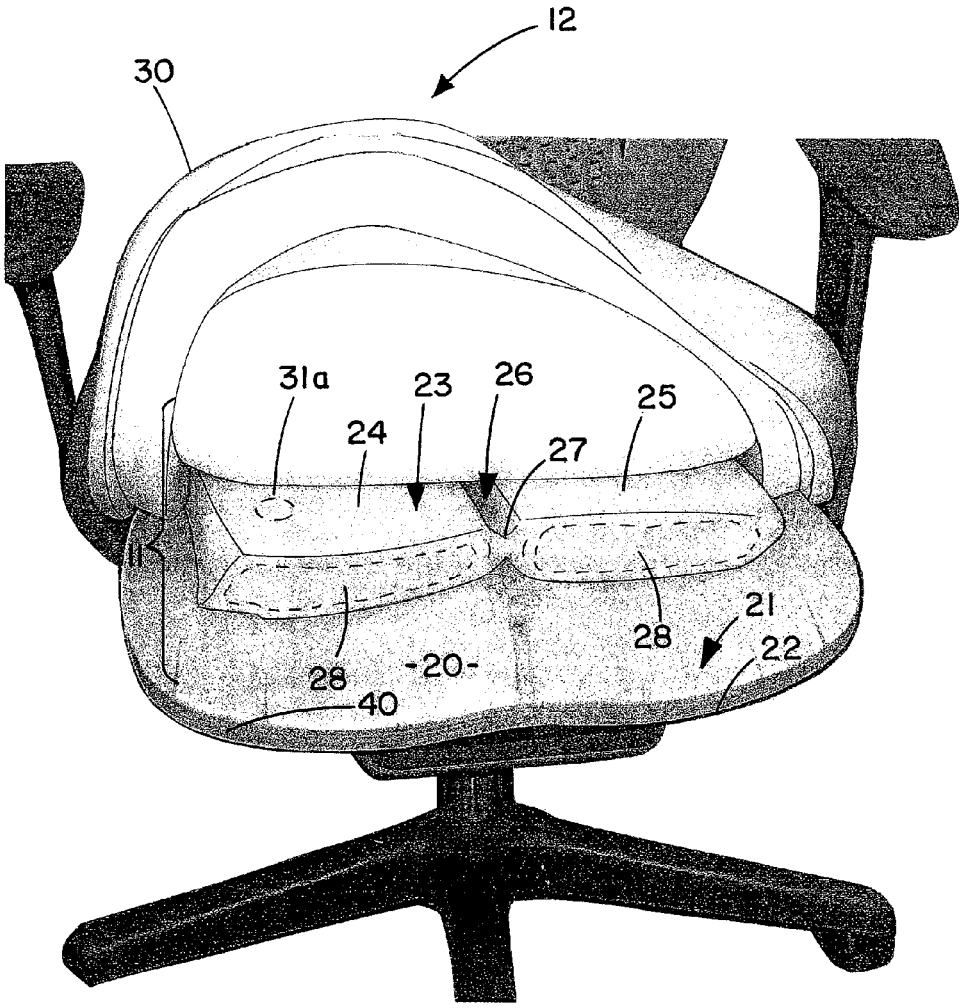
FIG. 2 is a an illustration of the seat cushion of FIG. 1 with the interior parts exposed to show the fluid bladder retainer cover and outer cover.
Figure 3:
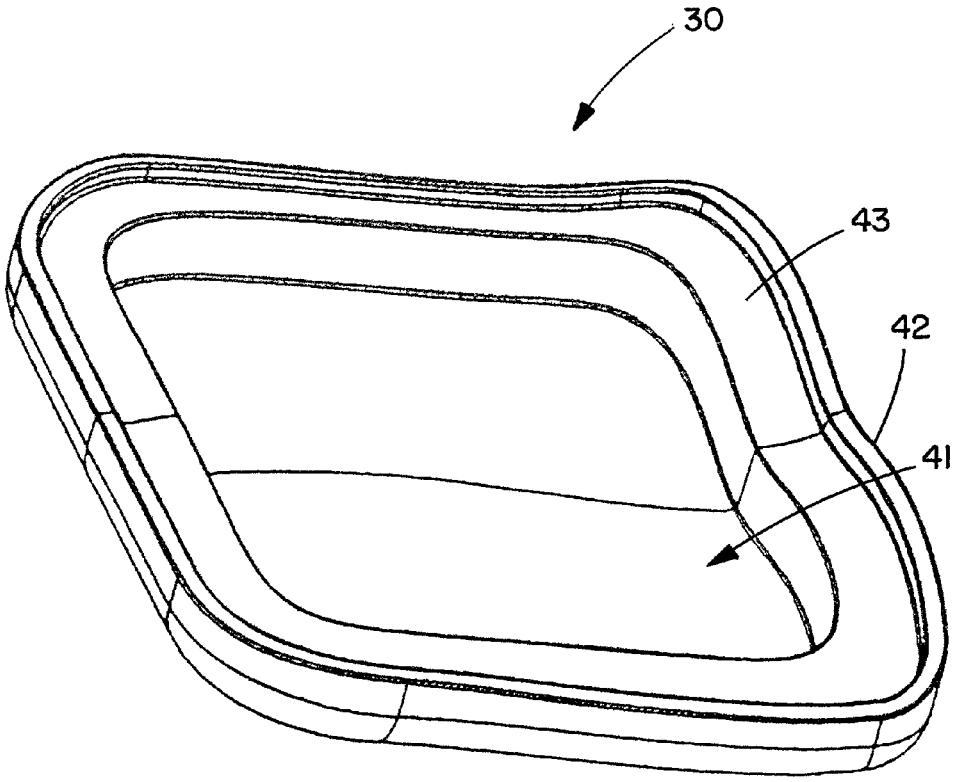
FIG. 3 is an isometric view of the resilient retaining covering for the fluid bladders shown inverted such that the usually downward facing recessed area is facing upward to facilitate illustrating the resilient retaining covering.
Figure 4:
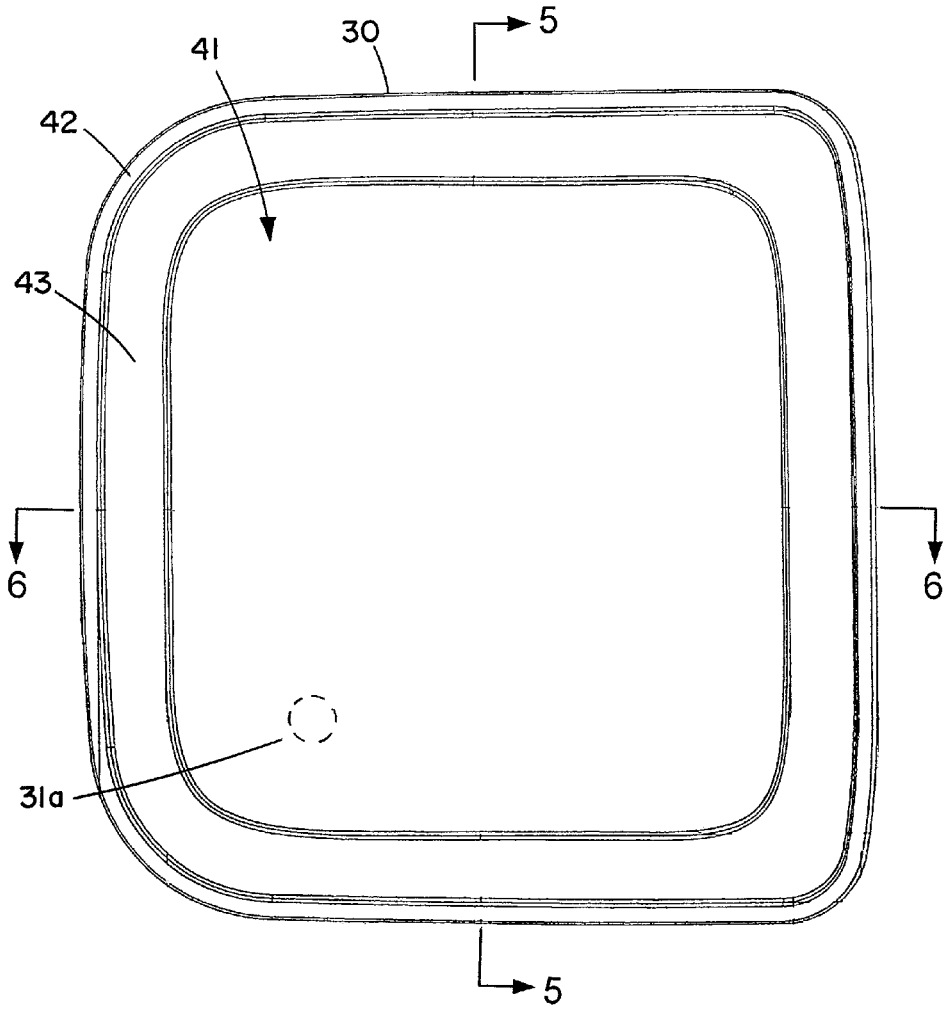
FIG. 4 is bottom plan view of the resilient retaining covering looking into the recessed area that is seen in FIG. 3.
Figure 5:
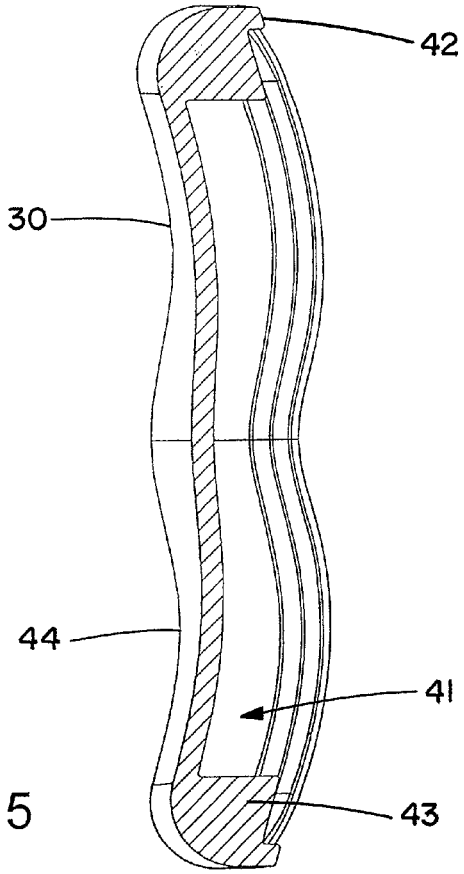
FIG. 5 is a section view of the resilient retaining covering looking in the direction of the arrows 5-5 of FIG. 4.
Figure 6:
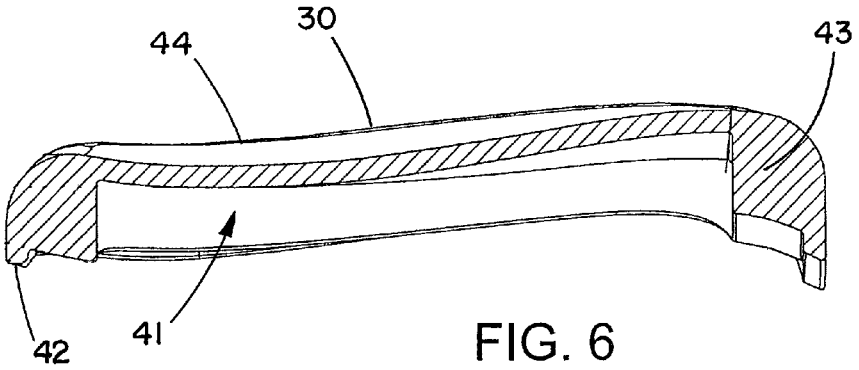
FIG. 6 is a section view of the resilient retaining covering looking in the direction of the arrows 6-6 of FIG. 5.

Referring to FIG. 2, the seat cushion 11 is shown having been removed from the chair 10 for illustration purposes and having portions partially pulled apart to show several parts of the seat cushion. The seat cushion 11 includes a support base 20 having a top 21 and a bottom 22. The seat cushion 11 also includes fluid bladder 23 having a plurality of fluid chambers, in the embodiment illustrated there are two fluid chambers 24, 25. A mechanical connection 26 is provided between respective fluid chambers 24, 25; and a restricted or limited fluid flow connection 27 is between the fluid chambers. The fluid chambers 24, 25 may be discrete bladder sections connected together by the mechanical connection 26. The mechanical connection 26 between fluid chambers may be provided by a member between and attached to the fluid chambers. Alternatively, the two fluid chambers may be provided from a single fluid chamber that is crimped, heat sealed or otherwise formed along the line of the mechanical connection 26 to divide the one fluid chamber into two fluid chambers. Other techniques may be used to form and to attach the fluid chambers. Although the embodiment illustrates two fluid chamber, there may be more than two fluid chambers and each may be directly mechanically attached to all, e.g., in a two by two array, or may be mechanically connected in a row, and so on.

As is seen in FIG. 2, the mechanical connection 26 extends in a direction that generally is from the front toward the back of the support base 20. A portion of the mechanical connection 26 may be non-fluid transmissive; and another portion of the mechanical connection may include the restricted fluid flow connection 27 described below. The mechanical connection 26 may include fluid transmissive sections 27 that are at least two lesser extent portions than the non-fluid transmissive section of the mechanical connection 26. The fluid transmissive sections 27 may be spaced from each other and be, respectively, relatively close to ends of the linear extent of the mechanical connection 26 to provide a desired flow between fluid chambers 24, 25 and, thus, a desired sensation to a user as fluid flows between chambers when the user may shift weight, e.g., forward to back or left to right, on the seat cushion. 11.

Each of the fluid chambers 24, 25 of the bladder 23 is formed of a fluid impermeable exterior material or housing, e.g., impermeable to air, so as to retain fluid in the interior of the fluid chambers. The fluid impermeable material may be flexible so that it is relatively easily deformable in response to force or pressure applied to it to change the interior volume of the fluid chamber; and, if desired, the fluid impermeable material also may have a characteristic of being resilient, e.g., able to expand and resiliently to contract to unexpanded condition. Also, inside the fluid chambers 24, 25 is a biasing member 28 that tends to bias the fluid chamber to a somewhat expanded condition, e.g., somewhat analogous to the condition of a rubber or rubberized hot water bottle that is filled with water. The biasing member may be, for example, an open cell foam, e.g., open cell upholstery foam such as that used in a seat cushion or sofa cushion. Such biasing material tends to maintain its shape when uncompressed by an applied force or pressure, but is able to be compressed in response to an applied force or pressure.

Briefly, in operation of the bladder 23, e.g., as used in the seat cushion 11, air is in both fluid chambers 24, 25 in some space that is not occupied by the biasing members therein and also in some of the space provided in the cells of the open cell foam. The fluid chambers 24, 25 are fluidically connected by the fluid flow connection 27. Absent an exterior force or pressure being applied to the bladder 23, e.g., by a person sitting on the bladder or on a seat cushion that includes the bladder, the fluid chambers 24, 25 would have approximately the same size, shape and interior air pressure. However, in response to force or pressure being applied to one fluid chamber and not to the other or to a difference in force or pressure being applied to one fluid chamber relative that being applied to the other, air will tend to flow through the fluid connection 27 from one fluid chamber to the other. For example, the fluid chamber to which force or pressure is applied or that has the larger force or pressure being applied will tend to expel air through the fluid connection 27 into the other fluid chamber; and the biasing material in the chamber from which air is being expelled will tend to be compressed.

The fluid connection 27 is limited or restricted in the sense that it only permits a limited flowing of air through air passages therein as compared to an unrestricted air flow. For example, the restriction in flow may be provided by determining the size and/or number of flow passages between respective fluid chambers. Therefore, in response to air being forced from one fluid chamber 24, 25 to the other fluid chamber, there is a gradual flow of air through the fluid connection. The result is that for a person sitting on the seat cushion having the bladder 23, one bladder will tend to be somewhat gradually compressed in size while the other bladder chamber somewhat correspondingly gradually expands in size; the sensation to a user may be similar to a sensation as though sitting on a seat that has a gel material or other relatively viscous material and the flowing of the gel material from one side to the other side of the seat.

Figure 7:
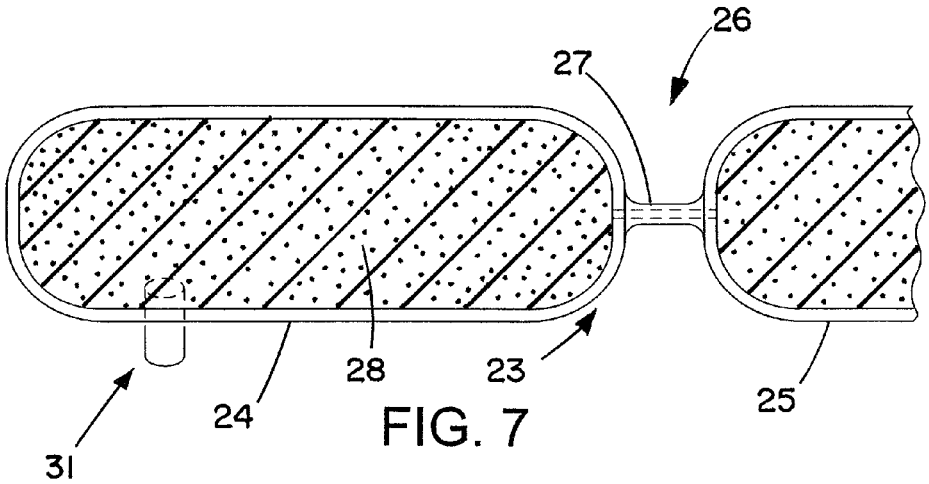
FIG. 7 is a schematic section view of one portion of a fluid bladder with a fluid valve.
Figure 8:
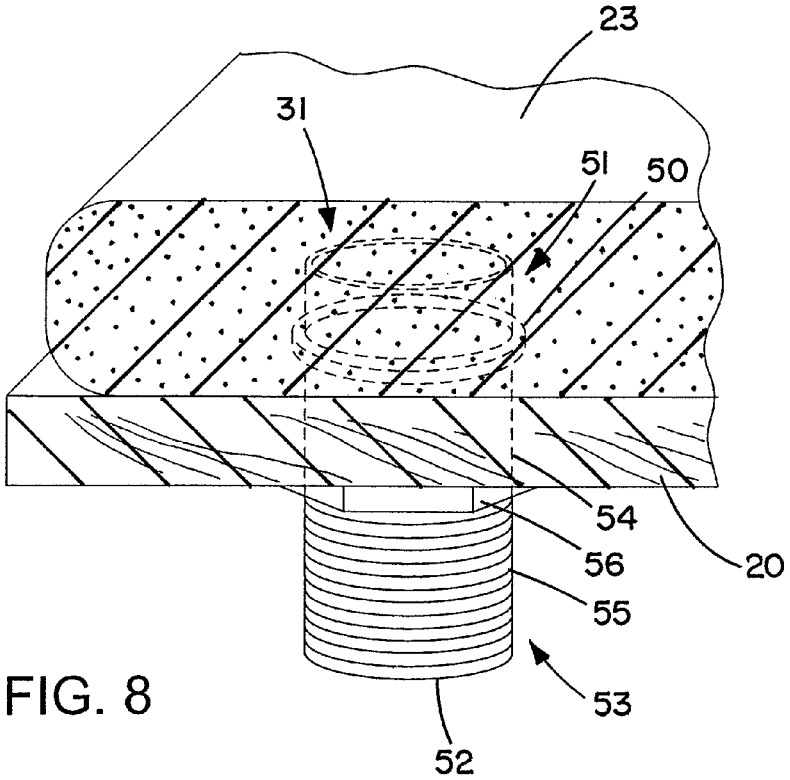
FIG. 8 is a fragmentary enlarged section view of the mounting arrangement of the fluid valve of FIG. 7.

As is shown in FIGS. 2, 7 and 8, the seat cushion 11 also includes a resilient retaining cover 30 over the fluid bladder 23, a valve mechanism 31 in fluid coupled relation to the fluid bladder to provide and to exhaust fluid from the fluid chamber, and a mechanical connection 32 of the valve mechanism to the support base 20. These parts are described below also with respect to FIGS. 3-8. For the illustration in FIG. 2 the retaining cover 30 has been pulled away from the support base 20 and bladder 23 to facilitate showing the structure and interrelation ship of these parts of the seat cushion 11. Also, in FIG. 2 a dotted outline circle 31*a* illustrates the approximate location at which the valve mechanism 31 may be relative to the bladder 23 and the support base 20. In the embodiment the valve mechanism extends from the bottom of the bladder facing the support base and extends through the support base, e.g., as is illustrated in further detail in FIGS. 7 and 8.

As is seen in FIG. 2 the support base 20 has an edge 40. The resilient retaining cover 30 covers the fluid bladder 23, fits about the edge 40 of the support base 20, and helps to hold the fluid bladder in position on the support base. Moreover, as is described further below, the valve mechanism 31 also helps to hold the fluid bladder 23 in position on the support base, as is shown further in FIGS. 7 and 8.

Turning to FIGS. 3-6, the resilient retaining cover 30 is shown. The cover 30 has a cavity or recessed portion 41 in which the fluid bladder may be located, a wall or flange 42 that covers the edge 40 of the support base, a retaining wall 43 that circumscribes the cavity 41 to define the cavity and also to hold the bladder 23 and the cover 30 in relative position to each other. The top 44 of the cover 30 covers the bladder 23. When a person sits on the seat cushion 11, the person's weight is applied to the top 44 of the cover; the force or pressure is applied via the cover 30 to the fluid bladder and via the fluid bladder to the support base 20. The retaining wall retains the fluid bladder 23 and cover 30 in relative position as illustrated during such use; and the edge wall or flange 42 holds the cover to the support base while also providing a soft and somewhat protected covering over the edge 40 of the support base for comfort of a user and to avoid damaging the support base edge. The fluid chambers 24, 25 of the bladder 23 may be rectangular profile (plan view), providing a rectangular profile for the bladder, and the cavity 41 may be of similar shape so that the bladder fits in relatively close relation to the cover 30 in the cavity 41. The bladder 23 and cover 30 together extend over, i.e., they cover, the entire support base 20. The bladder 23 covers a substantial portion of the support base 20 less the lateral thickness extent of the retaining wall 43 of the cover, for example.

The resilient retaining cover 30 may be a resilient foam material. The cover may be molded as a single piece; it may be formed of several pieces that are adhered together; or it may be otherwise formed. The foam material may be, for example, of the type typically used in furniture seat cushions or may be some other material.

In the illustrated embodiment, the bladder sections are connected in side by side parallel relation and the fluid chambers are fluidically coupled to each other, as was mentioned above. The resilient retaining cover 30 holds the bladder sections in generally fixed relation to each other while permitting some movement of respective bladder sections (fluid chambers) and expansion and contraction of respective fluid chambers of the bladder sections as fluid flows between respective fluid chambers in response to external pressure applied to the fluid bladder, e.g., as a person sits on the seat cushion 11.

Turning to FIGS. 7 and 8, the valve mechanism 31 and its attachment to both the bladder 23 and to the support base 20 are shown. The valve mechanism 31 may be a conventional valve that can be squeezed to allow air flow in either direction or may have sliding portions that can be slid to open and close the valve to permit and to block air flow, respectively. A user may operate the valve mechanism 31 by reaching beneath the support base 20 and appropriately manipulating the valve by touching, holding, squeezing, etc., the part 31*b* of the valve that is exposed beneath the support base 20. An end 31*c* of the valve mechanism 31 is exposed inside the fluid chamber 24.

In using the seat cushion, a may open the valve and permit air to flow into the fluid chamber 24. Air may flow through the fluid paths 27 into the other fluid chamber 25. The air may be drawn in via the valve under the influence of the biasing member 28 as it tends to expand when force/pressure is not otherwise applied to the biasing member. The valve mechanism may be closed and the seat cushion 11 used, e.g., a person may sit on the seat cushion 11 of the chair 10. If a user desires to have a different seat characteristic, the user may hold open the valve mechanism 31 while sitting on the seat cushion, thereby to force air out from the fluid chambers; and after a desired amount of air has been expelled through the valve, the user may close the valve. The seat cushion 11 then may be used with a reduced amount of air in the fluid chambers of the bladder 23.

As is seen in FIG. 8, the valve mechanism includes a flange 50 that is integrally molded in the material of which the bladder 23 is formed, thus forming an integral molded structure 51. Alternatively, the integral molded structure may be formed by adhesively bonding the valve mechanism to the bladder. For example, the valve mechanism 31 includes a case 52 that may extend through the material of which the bladder 23 is formed between the inside of a fluid chamber, e.g., fluid chamber 24, to outside the fluid chamber; and a sealing material, cement, adhesive, and so on may be applied at the interface between a side wall of the case 52 to secure the case of the valve and the bladder 23 as an integral structure.

Additionally, the valve mechanism 31 is attached to the support base 20 and extends below the bottom 22 of the support base for access by a user. Moreover, the valve mechanism 31 is attached to the support base; and since the valve mechanism is attached to the bladder, the valve mechanism also holds the bladder to the support base. A fastening mechanism 53 fastens the valve mechanism 31 to the support base. The fastening mechanism includes a hole 54 through the support base that bears on the case 52 of the valve mechanism. The fastening mechanism 53 also includes a thread 55 on the case 52 and a nut 56 that can be turned onto the thread 55 to bear against the bottom 22 of the support base. The nut 56 may pull the case downward relative to the illustration to tend to bull the flange 50 toward the top 21 of the support base, thus forming a relatively secure holding of the valve mechanism 31 to the support base and also holding the bladder 23 to the support base. If the case 52 and material of which the bladder 23 is formed and adhesive material that holds them together is used to provide the integral structure 52, the fastening mechanism may pull the integral structure 52 toward the support base to provide a relatively secure holding of the bladder 23 to the support base 20.

As is shown in FIG. 1, a fabric material cover 59 may be applied over the resilient retaining cover 30. The fabric cover may be permanently stapled to the bottom 22 of the support base 20. Alternatively, the fabric cover 59 may include an elastic material that extends or is positioned beneath the bottom 22 of the support base and securely holds the fabric cover against the resilient retaining cover 30, e.g., to provide a finished seat cushion 11 illustrated in FIG. 1.

Figure 9:
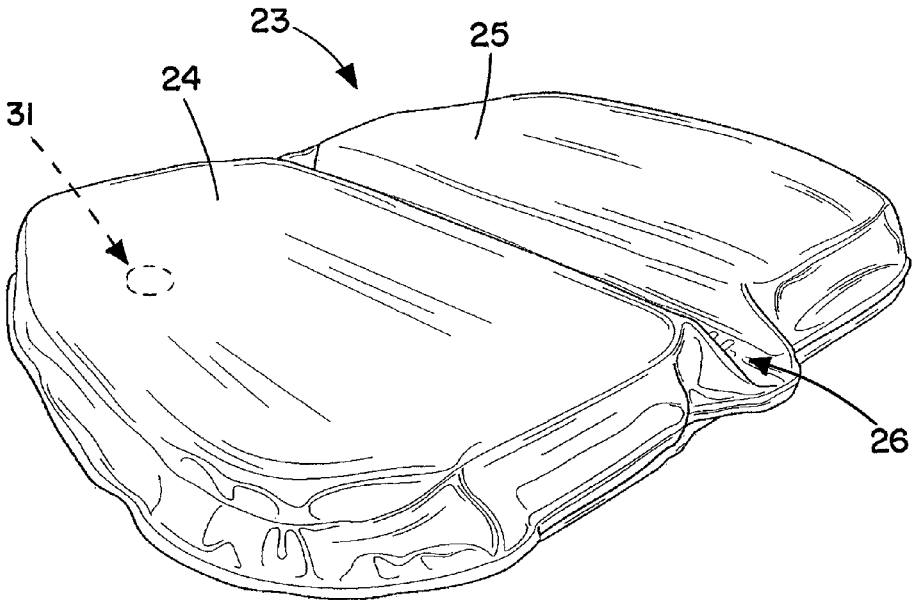
FIG. 9 is a schematic isometric view of the fluid bladder generally looking down at a fluid bladder.
Figure 10:
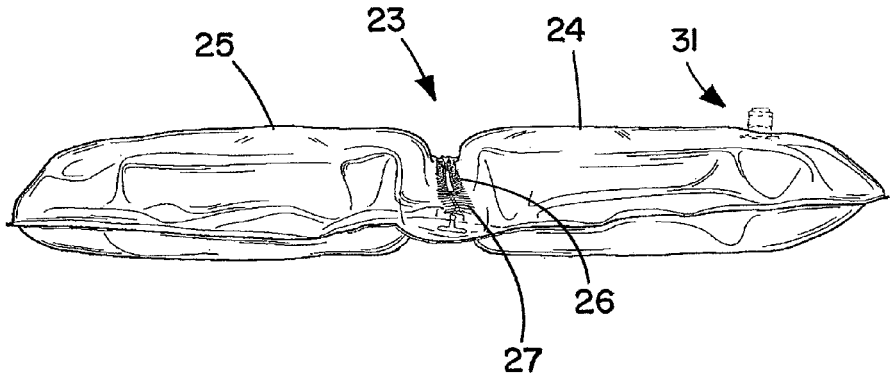
FIG. 10 is a schematic isometric view of the fluid bladder generally looking from a side of the fluid bladder.
Figure 11:
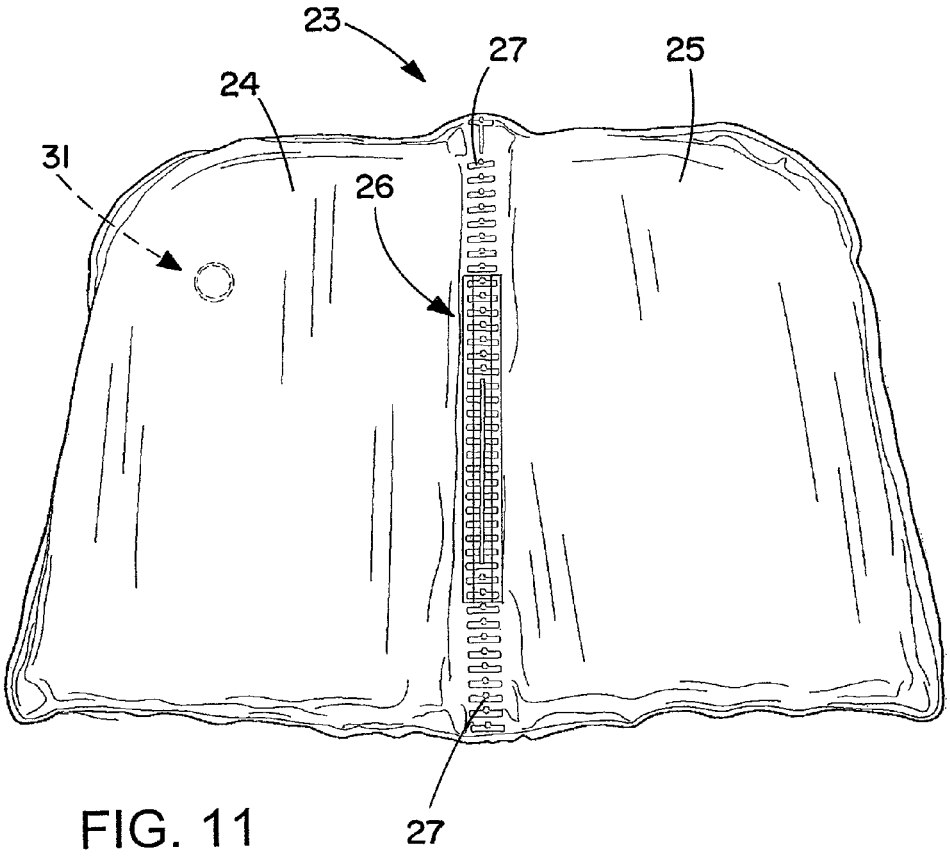
FIG. 11 is a schematic top plan view of the fluid bladder showing two bladder chambers attached together with provision for restricted or limited fluid flow between the bladder chambers.

FIGS. 9, 10 and 11 are schematic illustrations of an example of a bladder 23, fluid chambers 24, 25, mechanical connection 26 and fluid connection 27 and valve mechanism 31. In FIG. 9 the bladder 23 is upside down to show the valve mechanism 31. In FIGS. 10 and 11 the bladder is facing correctly such that the bladder would extend beneath the fluid chamber 24 (left-side fluid chamber as illustrated).

Figure 12:
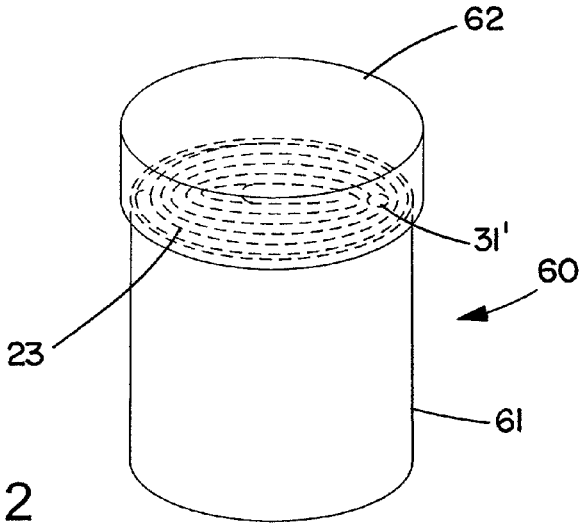
FIG. 12 is a schematic illustration of a seat kit.

Briefly referring to FIG. 12, a seat kit 60 includes a fluid bladder 23 having, as was described above, at least two interconnected bladder sections, a mechanical connection between the bladder sections, including a restrictive fluid flow connection between the bladder sections, the bladder sections being generally planar and foldable in overlying relation over each other along the mechanical connection, a valve mechanism 31' in a side edge of at least one of the bladder sections (rather than at the bottom as in the other embodiments), and a housing or container 61 to hold the bladder with the bladder sections in folded relation, the bladder being removable from the container for unfolded use as a seat cushion independently of a support base, e.g., not being attached to a support base 20. Rather, the fluid bladder 23 may be removed from the container 61 and placed on a stadium seat, automobile seat, and so on. The bladder 23 comprises exterior walls bounding a chamber, and a resilient compressible material inside the chamber. Furthermore a resilient cover, e.g., as shown at 30, may be provided overlying at least one surface of both bladder sections. Still further, a fabric-like cover may be provided overlying the resilient cover.

Though the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A seat cushion, comprising a support base having a top and bottom, a fluid bladder supported by the support base above at least part of the top of the support base, the fluid bladder having at least two discrete bladder sections that are resilient, capable of containing a fluid, and extending in side by side generally parallel relation to each other, a mechanical connection connecting adjacent bladder sections, the mechanical connection including a substantial extent in a direction that generally is from the front toward the back of the support base, and that does not transmit fluid between bladder sections and a lesser extent that provides restricted fluid flow between bladder sections, a biasing member in the fluid chamber tending to bias the fluid chamber to an at least partly expanded condition, a resilient retaining covering over the fluid bladder, a valve mechanism in fluid coupled relation to the fluid bladder to provide and to exhaust fluid from the fluid chamber, and a mechanical connection of the valve mechanism to the support base.

2. The seat cushion of claim 1, wherein at least part of the bladder is molded to the valve mechanism as an integral structure.

3. The seat cushion of claim 1, wherein at least part of the valve mechanism extends through the support base and is accessible beneath the support base for manual operation to provide and to exhaust fluid from the fluid chamber.

4. The seat cushion of claim 1, wherein the biasing member comprises a resilient open cell foam-like material.

5. The seat cushion of claim 1, wherein the support base is relatively rigid compared to the fluid bladder that is relatively more flexible than the support base, and wherein the fluid bladder is generally in parallel overlying relation to the support base and overlies less than the entire area of the support base.

6. The seat cushion of claim 1, wherein the valve mechanism is mechanically connected to the support base and to the fluid bladder to retain the fluid bladder to the support base.

7. The seat cushion of claim 1, wherein the biasing member comprises a resilient bias member tending to urge the fluid bladder to an open volume state of the fluid chamber.

8. The seat cushion of claim 1, wherein the valve mechanism includes a tube and a two-way manually operable flow control valve.

9. The seat cushion of claim 1, wherein the valve mechanism is selectively actuable to permit fluid to flow into and out from the fluid chamber and when the valve mechanism is unactuated it blocks fluid.

10. The seat cushion of claim 1, wherein the valve mechanism is connected to one of the discrete bladder sections.

11. The seat cushion of claim 1, wherein the resilient retaining covering comprises resilient foam material covering the bladder sections holding them to the support base.

12. The seat cushion of claim 11, further comprising a fabric-outer covering.

13. A seat cushion, comprising a support base having a front and back, a fluid bladder having at least two discrete bladder sections that are resilient, capable of containing a fluid, and extending in side by side generally parallel relation to each other, a mechanical connection connecting adjacent bladder sections, the mechanical connection including a substantial extent in a direction that generally is from the front toward the back of the support base, and that does not transmit fluid between bladder sections and a lesser extent that provides restricted fluid flow between bladder sections, and a resilient retaining covering material over the fluid bladders.

14. A chair comprising the seat cushion of claim 13, further comprising a support structure supporting the seat cushion in orientation for a person to sit on the seat cushion.

15. The seat cushion of claim 13, wherein the bladder sections are generally planar and foldable in overlying relation over each other along the mechanical connection.

16. The seat cushion of claim 13, wherein the lesser extent of the mechanical connection provides fluid flow paths between respective bladder sections and wherein the flow path dimensions are sufficiently small to restrict unimpeded fluid flow between bladder sections providing in use the sensation of flow viscous material between bladder sections in response to difference in pressure applied to respective bladder sections.

17. The seat cushion of claim 13, wherein the mechanical connection includes at least two lesser extent portions that respectively are spaced apart from each other.

18. The seat cushion of claim 17, wherein at least two lesser extent portions of the mechanical connection are, respectively, in relative proximity to respective ends of the mechanical connection.

19. The seat cushion of claim 13, wherein the bladder sections are of generally rectangular shape, and the mechanical connection extends between bladder sections substantially along the entire length of a pair of connected side edges of the bladder sections.

20. The seat cushion of claim 13, wherein the fluid bladder includes a fluid chamber, and further comprising a resilient bias member tending to urge the fluid bladder to an open volume state of the fluid chamber.

21. The seat cushion of claim 13, further a valve mechanism in fluid coupled relation to the fluid bladder to provide and to exhaust fluid from the fluid chamber.

22. The seat cushion of claim 21, further comprising a mechanical connection of the valve mechanism to the support base.

23. The seat cushion of claim 13, further wherein the resilient retaining covering comprises resilient foam material, and wherein the foam material has a cavity, the bladder positioned at least partly in the cavity, and walls of the cavity constrain movement of the bladder and in cooperation with the support base retain the bladder in position with the bladder sections in side by side relation.

24. The seat cushion of claim 23, further comprising a fabric cover.

25. A seat cushion, comprising a support base having an edge, a fluid bladder supported by the support base, wherein the fluid bladder comprises plural bladder sections, each having a fluid chamber, the bladder sections connected in side by side parallel relation and the fluid chambers being fluidically coupled to each other via restrictive fluid flow paths, and the resilient member resiliently holds the bladder sections in generally fixed relation to each other while permitting some movement of respective bladder sections and expansion and contraction of respective fluid chambers of the bladder sections as fluid flows between respective fluid chambers in response to external pressure applied to the fluid bladder, and a resilient material over at least part of the fluid bladder, the resilient material including a cavity portion, at least part of the fluid bladder in the cavity, and a wall portion of the resilient material covering an edge of the support base.

26. The seat cushion of claim 25, wherein the resilient material is a resilient foam material.

27. The seat cushion of claim 25, wherein the support base is substantially rigid.

28. The seat cushion of claim 25, wherein fluid in the fluid bladder is air.

29. The seat cushion of claim 25, wherein respective sections of the fluid bladder are fluidically interconnected to permit flow of fluid between respective sections in response to external pressure applied to the fluid bladder.

30. A chair comprising the seat cushion of claim 1, further comprising a support structure supporting the seat cushion in orientation for a person to sit on the seat cushion.

31. A seat cushion, comprising a fluid bladder having at least two discrete bladder sections that are resilient, capable of containing a fluid, and extending in side by side relation to each other, and a mechanical connection between the bladder sections, the mechanical connection including a substantial extent that does not transmit fluid between bladder sections and a lesser extent that provides restricted fluid flow between bladder sections.

32. The seat cushion of claim 31, wherein the bladder comprises exterior walls bounding a chamber, and a resilient compressible material inside the chamber.

33. The seat cushion of claim 31, further comprising a resilient cover overlying at least one surface of both bladder sections.

34. The seat cushion of claim 31, further comprising a valve in a side edge of at least one of the bladder sections.

35. The seat cushion of claim 31, further comprising a container to hold the bladder with the bladder sections in folded relation, the bladder being removable from the container for unfolded use as a seat cushion.

* * * * *